US010849438B1

(12) United States Patent
Schulman

(10) Patent No.: US 10,849,438 B1
(45) **Date of Patent: *Dec. 1, 2020**

(54) MODULAR MATTRESS RENEWAL SYSTEM

(71) Applicant: Underpucks LLC, Sandy Hook, CT (US)

(72) Inventor: Jared D. Schulman, Sandy Hook, CT (US)

(73) Assignee: Underpucks LLC, Sandy Hook, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/449,409

(22) Filed: Jun. 23, 2019

Related U.S. Application Data

(63) Continuation-in-part of application No. 14/931,538, filed on Nov. 3, 2015, now Pat. No. 10,327,564.

(51) Int. Cl.
*A47C 27/14* (2006.01)
*A47C 27/15* (2006.01)
*A47C 27/16* (2006.01)

(52) U.S. Cl.
CPC ..... *A47C 27/148* (2013.01); *A47C 27/15* (2013.01); *A47C 27/14* (2013.01); *A47C 27/146* (2013.01); *A47C 27/16* (2013.01)

(58) Field of Classification Search
CPC ..... A47C 27/14; A47C 27/146; A47C 27/144; A47C 27/15; A47C 27/16; A47C 27/20; A47C 31/123; A47C 19/205; A47C 19/027; A47C 21/06; A47C 27/148
See application file for complete search history.

(56) References Cited

U.S. PATENT DOCUMENTS 1,353,260 A * 9/1920 Monks ..... A47C 23/047 5/659
2,434,641 A * 1/1948 Burns ..... A47C 27/081 267/117
2,861,278 A * 11/1958 Young ..... A47C 19/027 5/659
3,319,274 A * 5/1967 Upton ..... A47C 27/144 5/701
3,605,145 A * 9/1971 Graebe ..... A47C 27/081 5/706
3,751,742 A * 8/1973 Worley ..... A47C 19/027 5/659
3,806,968 A * 4/1974 Robey ..... A47C 20/027 5/660
4,005,236 A * 1/1977 Graebe ..... A47C 27/081 428/72

(Continued)

*Primary Examiner* — Nicholas F Polito
*Assistant Examiner* — Morgan J McClure
(74) *Attorney, Agent, or Firm* — Edwin D. Schindler

(57) ABSTRACT

A modular mattress renewal system includes a support lattice is made up of a plurality of compressible nodal foam blocks connected one to the other by block connectors that fit into guide apertures within the nodal blocks. The connectors themselves are also compressible and flexible and the compressible nodal foam blocks are provided with an adhesive portion that allows the user to customize the support necessary. Additionally, the nodal foam blocks have varying degrees of compressibility and varying compressibility gradients and are marked as such to further enhance the support customization possible. Thus, sagging mattresses or mattresses with indentations from use over time may be rehabilitated.

16 Claims, 18 Drawing Sheets

(56) References Cited

U.S. PATENT DOCUMENTS 4,745,645 A * 5/1988 McWilliams ..... A47C 21/06 5/659
4,815,155 A * 3/1989 Sommers ..... A47C 19/027 5/417
4,852,195 A * 8/1989 Schulman ..... A61G 7/05776 5/713
4,878,258 A * 11/1989 Casey ..... A47G 9/0207 5/420
4,965,897 A * 10/1990 Taylor ..... A47C 20/00 5/643
5,066,001 A * 11/1991 Wilkinson ..... A63B 6/00 482/52
5,152,023 A * 10/1992 Graebe ..... A47C 27/081 5/654
5,313,679 A * 5/1994 Yamaguchi ..... A47C 19/045 254/93 HP
5,353,455 A * 10/1994 Loving ..... A47C 23/002 29/451
5,377,369 A * 1/1995 Shirai ..... A47C 23/005 5/236.1
5,448,789 A * 9/1995 Shirai ..... A47C 23/06 5/613
5,638,565 A * 6/1997 Pekar ..... A47C 4/54 5/653
5,640,731 A * 6/1997 Toedter ..... A47C 21/046 5/710
6,155,647 A * 12/2000 Albecker, III ..... A47C 1/146 297/228.12
6,308,354 B1 * 10/2001 Lilly ..... A47C 21/06 5/700
6,647,569 B1 * 11/2003 Tansek ..... A47C 17/64 5/186.1
6,763,611 B1 * 7/2004 Fusco ..... A43B 13/125 36/25 R
6,871,369 B1 * 3/2005 Long ..... A47C 21/06 5/655.9
7,036,162 B1 * 5/2006 Gatten ..... A47C 21/04 5/420
7,120,956 B1 * 10/2006 Liao ..... A47C 23/002 5/719
7,865,989 B2 * 1/2011 Steppat ..... A47C 27/144 5/719
8,298,648 B2 * 10/2012 Turner ..... A41D 13/05 428/138
9,038,221 B2 * 5/2015 Fraser ..... A61G 5/1043 5/654
9,066,599 B1 * 6/2015 Waggoner ..... A47C 27/00
9,241,578 B1 * 1/2016 Franken ..... A47C 21/06
9,265,354 B2 * 2/2016 Mason ..... A47C 27/148
9,510,690 B2 * 12/2016 Rawls-Meehan ..... A47C 7/14
9,561,396 B2 * 2/2017 Lazarchik
9,962,008 B1 * 5/2018 Omiste ..... A47C 27/001
2005/0172412 A1 * 8/2005 Pearson ..... A47C 21/06 5/659
2006/0117486 A1 * 6/2006 Clark ..... A47C 21/06 5/659
2007/0000060 A1 * 1/2007 Firestone ..... A47C 21/06 5/659
2007/0088392 A1 * 4/2007 Skiba ..... A43B 1/0045 607/2
2007/0283496 A1 * 12/2007 Skripps ..... A61G 7/05738 5/654
2008/0034501 A1 * 2/2008 Hyde ..... A61F 5/05 5/613
2008/0078033 A1 * 4/2008 Wyatt ..... A47C 27/082 5/727
2009/0126107 A1 * 5/2009 Kuo ..... A47C 27/144 5/400
2010/0223730 A1 * 9/2010 Pearce ..... A47C 27/144 5/655.5
2011/0004998 A1 * 1/2011 Losio ..... A47C 23/002 5/699
2011/0041252 A1 * 2/2011 DeFranks ..... A47C 27/064 5/655.8
2011/0047707 A1 * 3/2011 Hobson ..... A47C 27/144 5/691
2015/0189996 A1 * 7/2015 Scarlett ..... A47C 27/081 5/722
2016/0029810 A1 * 2/2016 Malkiewicz ..... A47C 27/20 5/724
2016/0286973 A1 * 10/2016 Quinn ..... A47C 20/02
2019/0090651 A1 * 3/2019 Gargalis ..... A47C 27/148

* cited by examiner

MODULAR MATTRESS RENEWAL SYSTEM

CROSS-REFERENCE TO RELATED APPLICATION

This is a continuation-in-part of U.S. patent application Ser. No. 14/931,538, filed Nov. 3, 2015, now U.S. Pat. No. 10,327,564.

BACKGROUND OF THE INVENTION

Technical Field of the Invention

The present invention relates generally to beds and, more particularly, to a mattress enhancement that allows the user to compensate for the sags or indentations in the mattress that occur over a period of use. Even more specifically, it relates to a mattress enhancement that is modular and that additionally allows its use on various sized mattresses and on the portions thereof that require additional support for the comfort of the user. Even more specifically it relates to a modular mattress support that has varying degrees of compressibility in each of the support modules and that has fully modifiable connectors between the support modules for the varying ranges of support that are required in each specific case.

Description of the Prior Art

The most pertinent prior art known to the inventor is disclosed by Franken, U.S. Pat. No. 9,241,578, issued Jun. 26, 2016; Lazarchik, U.S. Pat. No. 9,561,396, issued Feb. 7, 2017; and, Mason, U.S. Pat. No. 9,265,354, issued Feb. 26, 2016. Each of Franken, Lazarchik and Mason teach various supports that might be useful for supporting a mattress, having pluralities of supporting components that are either incorporated into the mattress structure or permanently fixed in place relative to one another and, as such, the number of analogous compressible nodal form blocks is not able to be varied between usages of the mattress, unlike that which is possible with the present invention.

Additional prior art made of record in the parent application prosecution includes Kuo, U.S. Patent Application Publication No. 2009/0126107 A1, published May 21, 2009; Fogg, U.S. Pat. No. 7,155,765, issued Jan. 2, 2007; Albecker, III, U.S. Pat. No. 6,155,647, issued Dec. 5, 2000; and Shirai, U.S. Pat. No. 5,377,369, issued Jan. 3, 1995, in addition prior art deemed by the inventor to be less pertinent to the subject matter and scope of the present invention.

Such additional, though less pertinent, prior art would include other support devices designed for cushioning, e.g., Morgan, U.S. Pat. No. 4,070,719, issued Jan. 31, 1978; Fogel, U.S. Pat. No. 6,192,538, issued Feb. 27, 2001; Shum, U.S. Pat. No. 6,401,282, issued Jun. 11, 2002; Landvik et al., U.S. Pat. No. 6,541,094, issued Apr. 1, 2003; Visser et al., U.S. Pat. No. 6,952,850, issued Oct. 11, 2005; Malzl, U.S. Pat. No. 7,805,791, issued Oct. 5, 2010; Gladney, U.S. Pat. No. 8,250,689, issued Aug. 28, 2012; Howard, U.S. Pat. No. 8,356,371. issued Jan. 22, 2013; Fukano, U.S. Pat. No. 8,370,979, issued Feb. 12, 2013; Mikkelsen et al., U.S. Pat. No. 8,418,297, issued Apr. 16, 2013; Witherell et al. U.S. Pat. No. 8,613,120, issued Oct. 22, 2013; and, Hawkins, U.S. Pat. No. 8,613,120, issued Dec. 24, 2013.

SUMMARY OF THE INVENTION

A primary object of the present invention is to provide a modular renewal system for an existing mattress.

Another object of the present invention is to provide a modular renewal system for an existing mattress where the interlocking support system is variously configurable to allow the system to be used on a variety of mattress sizes.

Yet another object of the present invention is to provide a modular renewal system for a mattress where the nodal blocks of the system may be made up of a variety of layers with varying compressibility, depending on the degree of support that needs to be added to the mattress.

Still yet another object of the present invention is to provide a modular renewal system for a mattress where the layering of the nodal blocks may be a single layer with an increasing density to provide a support gradient between the box spring and the mattress itself.

Another object of the present invention is to provide a modular renewal system for a mattress where the nodal block connectors extending between the necessary blocks are flexible to allow for user customization.

Yet another object of the present invention is to provide a modular renewal system where the layers or gradients in the nodal blocks provide a shock absorbing means.

Still yet another object of the present invention is to provide a modular renewal system for a mattress where the system itself is not detectable by the user once it has been put in place.

Still yet another object of the present invention is to provide a modular renewal system for mattresses or the like where the varying degrees of compressibility in the nodal blocks are color coded for ease in customization.

Additional objects of the present invention will appear as the description proceeds.

The present invention overcomes the shortcomings of the prior art by providing a fully customizable modular mattress renewal system that allows the user to compensate for the sleep indentations in the mattress that appear over time.

More particularly, in one particularly preferred embodiment of the present invention, a modular mattress renewal system is provided that includes a plurality of compressible nodal foam blocks, each of the compressible nodal foam blocks having a plurality of block connector guide apertures and further including nodal foam block adhesive portions with the plurality of compressible nodal foam blocks being a variable number of the compressible nodal foam blocks with the variable number of the compressible nodal foam blocks being adjustable for varying the number of compressible nodal foam blocks between uses of the modular mattress renewal system. A plurality of nodal foam rod-shaped block connectors are further included with each of the nodal foam rod-shaped block connectors having two nodal foam block connector engagement ends for being received in the block connector guide apertures; each the nodal foam rod-shaped block connector separating two compressible nodal foam blocks of the plurality of compressible nodal foam blocks in a non-contiguous spatial arrangement with empty spacing between said plurality of compressible nodal foam blocks, in which the plurality of compressible nodal foam blocks with said plurality of nodal foam rod-shaped connectors are placed underneath a mattress, rather than being incorporated into the mattress, and are fixed in place via the nodal foam block adhesive portions with the nodal foam rod-shaped block connectors being attached via the nodal foam block connector engagement ends for forming a supporting lattice for supporting at least a portion of the mattress by the plurality of compressible nodal foam blocks.

In a further preferred embodiment of the present invention, the compressible nodal foam blocks can be provided with a removable region (e.g., a central region being removable) that can be removed by the user, who would have the option of either using the mattress renewal system of the present invention without the removable region of the compressible nodal foam blocks, thereby allowing the removable region to remain empty, or, as an alternative, the user can replace the portions of the compressible nodal foam blocks that have been removed with other insertable foams able to be fitted into the removable regions which may have different textures or support capabilities. There can also be a plurality of removable regions for a single compressible nodal foam block, which may have a height that is greater, or less than, the height of the compressible nodal foam block.

Other objects and features of the present invention will become apparent when considered in combination with the accompanying drawing figures, which illustrate certain preferred embodiment of the present invention. It should, however, be noted that the accompanying drawing figures are intended to illustrate only select preferred embodiments of the claimed invention and are not intended as a means for defining the limits and scope of the invention.

BRIEF DESCRIPTION OF THE DRAWING FIGURES

In the drawing figures, wherein similar features are denoted with similar reference numerals throughout the several views.

Figure 13:
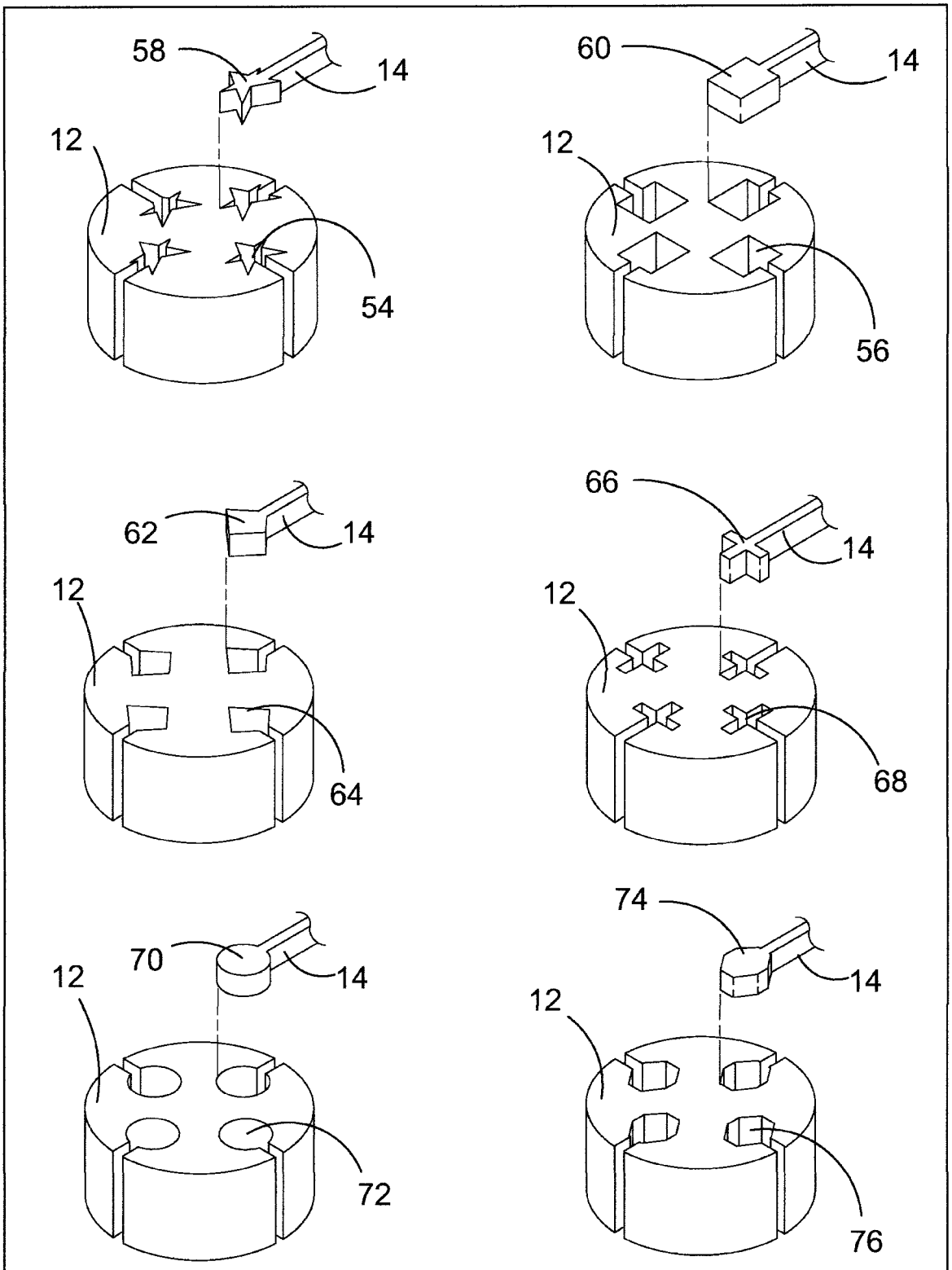
Figure 14A:
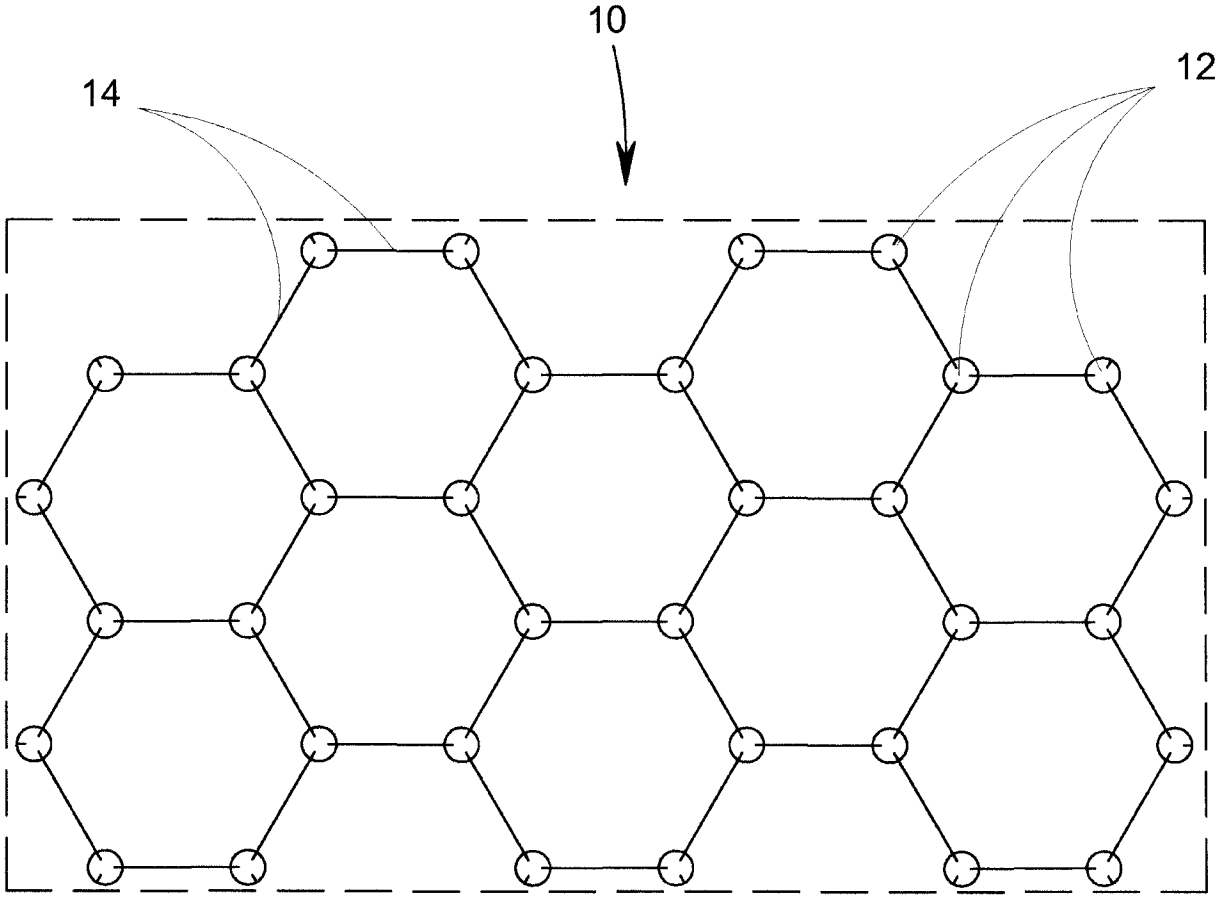
Figure 14B:
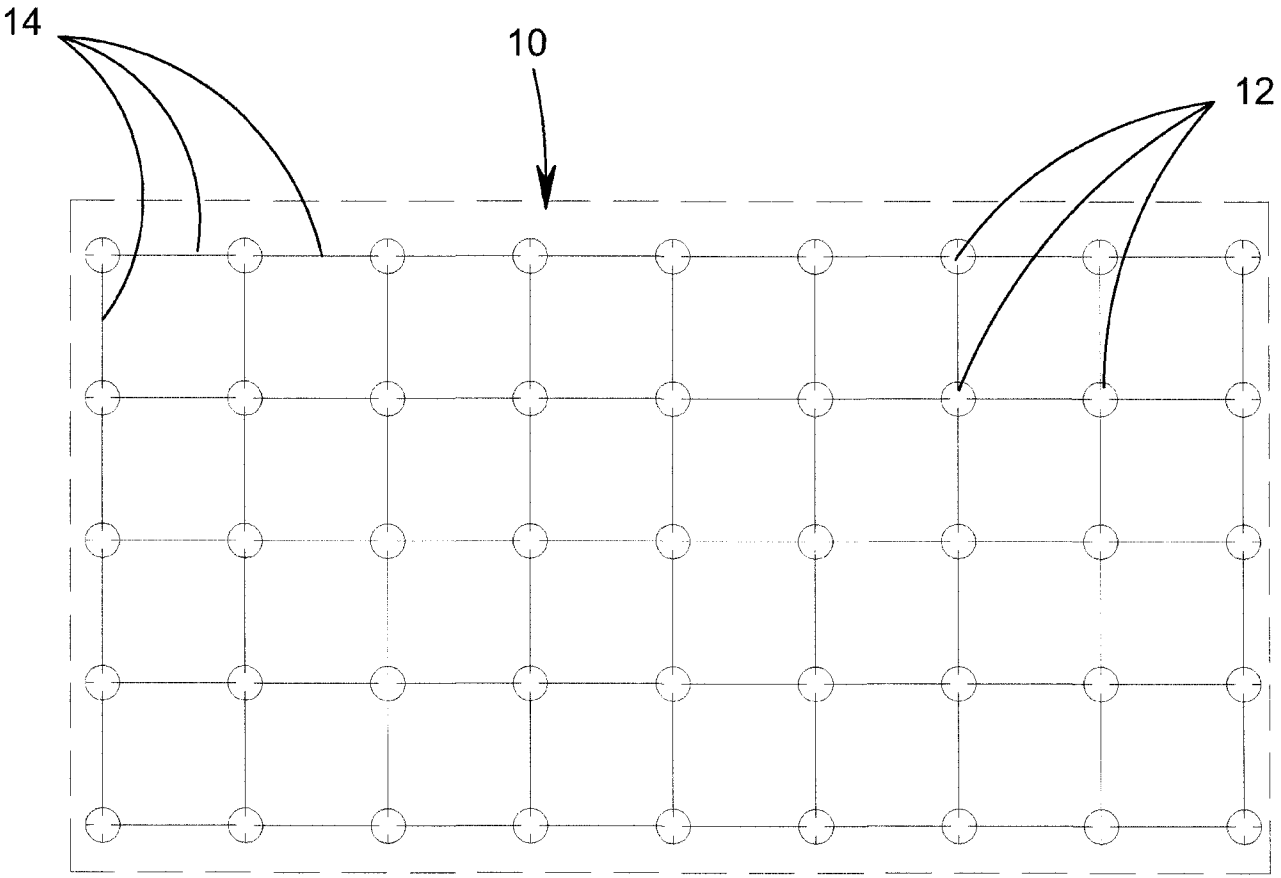
Figure 14C:
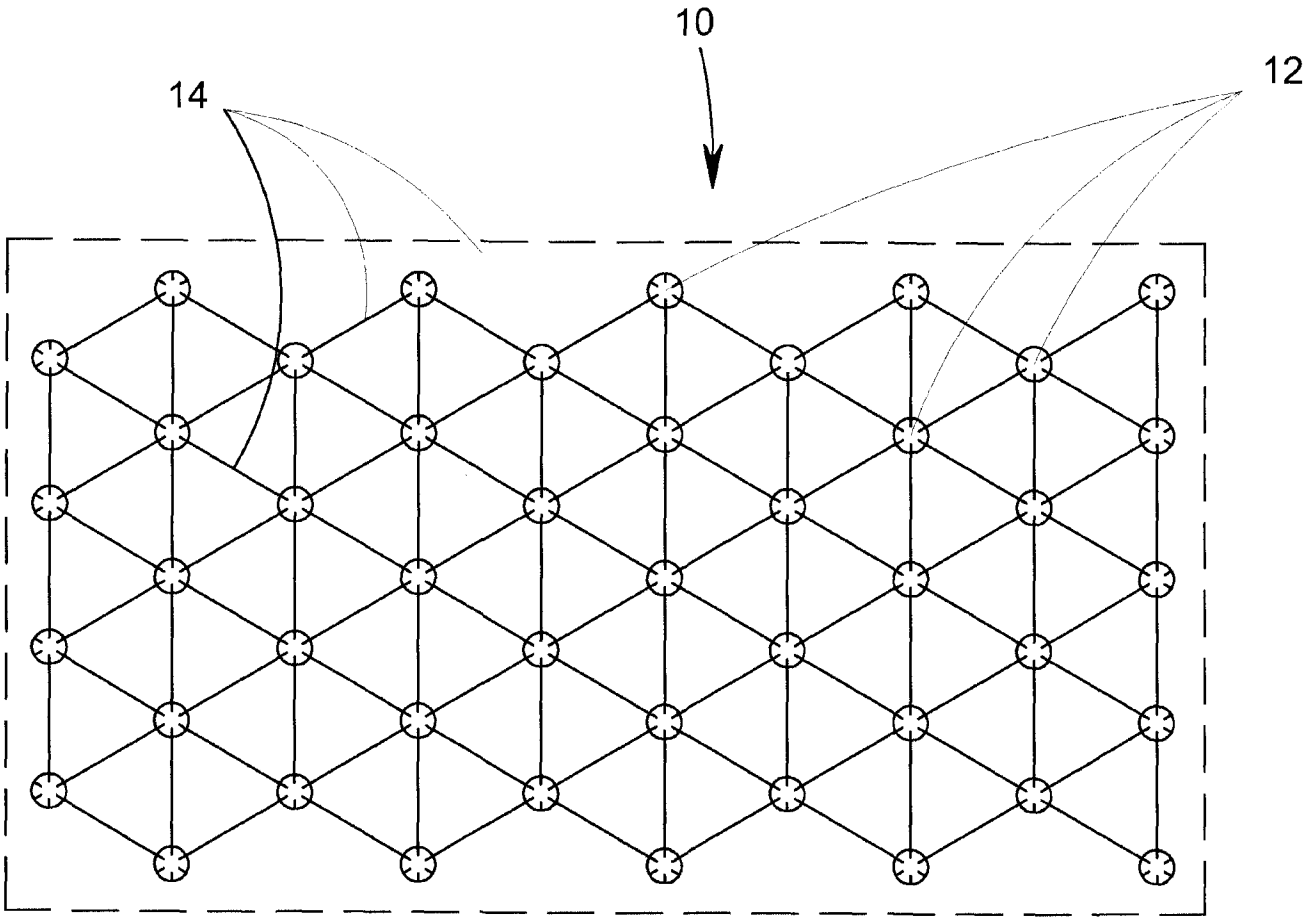
Figure 15:
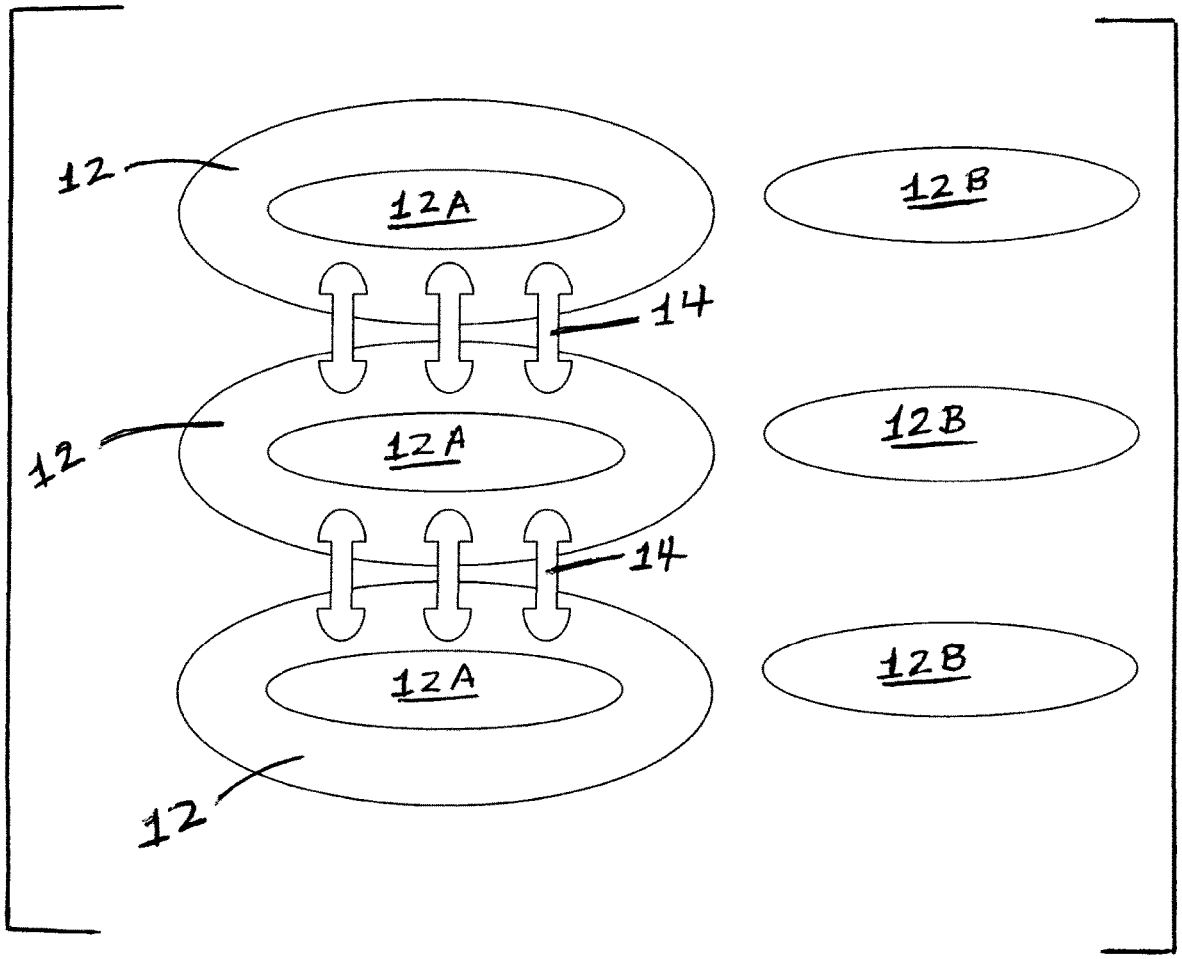
Figure 16:
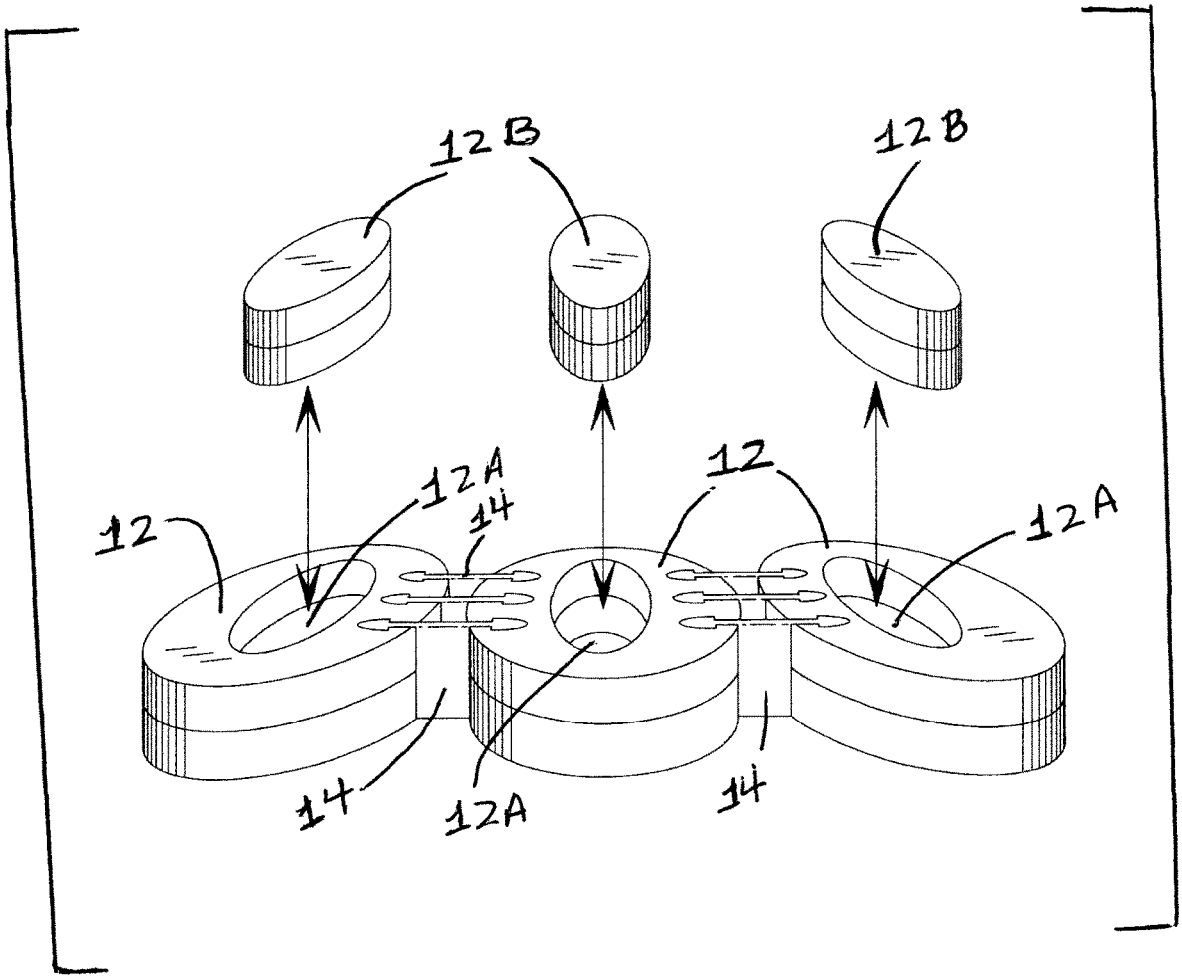

FIG. 13 presents prospective views of various configurations and contoured shapes for attachment of the nodal blocks and the various block connectors;

FIG. 14A is a plan view of the nodal blocks and the corresponding block connectors in a hexagonal configuration;

FIG. 14B is a plan view of the nodal blocks and the corresponding block connectors in a square configuration;

FIG. 14C is a plan view of the nodal blocks and the corresponding block connectors in a triangular configuration;

FIG. 15 is a perspective view of the nodal blocks, shaped as ovals, with a central region of the nodal blocks shown being removed, and the corresponding block connectors; and, FIG. 16 is a further prospective view of the nodal blocks, shaped as ovals, with the central regions of the nodal blocks being shown by arrows as being optionally removable and replaceable.

DESCRIPTION OF THE REFERENCED NUMERALS

Turning now descriptively to the drawings, in which similar reference characters denote similar elements throughout the several views, the figures illustrate the use of the present invention. With regard to the reference numerals used, the following numbering is used throughout the various drawing figures:

10 present invention
12 nodal foam blocks
12A nodal foam blocks with removable regions
12B removable regions of the nodal foam blocks
14 nodal block connectors
16 nodal block contoured guide apertures
18 single compressive layer nodal block
20 double compressive layer nodal block
22 triple compressive layer nodal block
24 adhesive base layer
26 mattress
28 box spring
30 mattress sleep indentations
32 sofa
34 bed
36 easy chair
38 block connector engagement ends
40 single foam layer
42, 42A double foam layer
44, 44A, 44B triple foam layer
46 support arrows
48 king-size box spring
50 king-size mattress
52 compressed nodal foam block
54 star guide aperture
56 square guide aperture
58 star guide connector end
60 square guide connector end
62 diamond-shaped connector end
64 diamond guide aperture
66 cross-shaped connector end
68 cross-shaped aperture
70 round connector end
72 round receiving aperture
74 hexagonal connector end
76 hexagonal receiving aperture

DETAILED DESCRIPTION OF THE DRAWING FIGURES AND PREFERRED EMBODIMENTS

Figure 1:
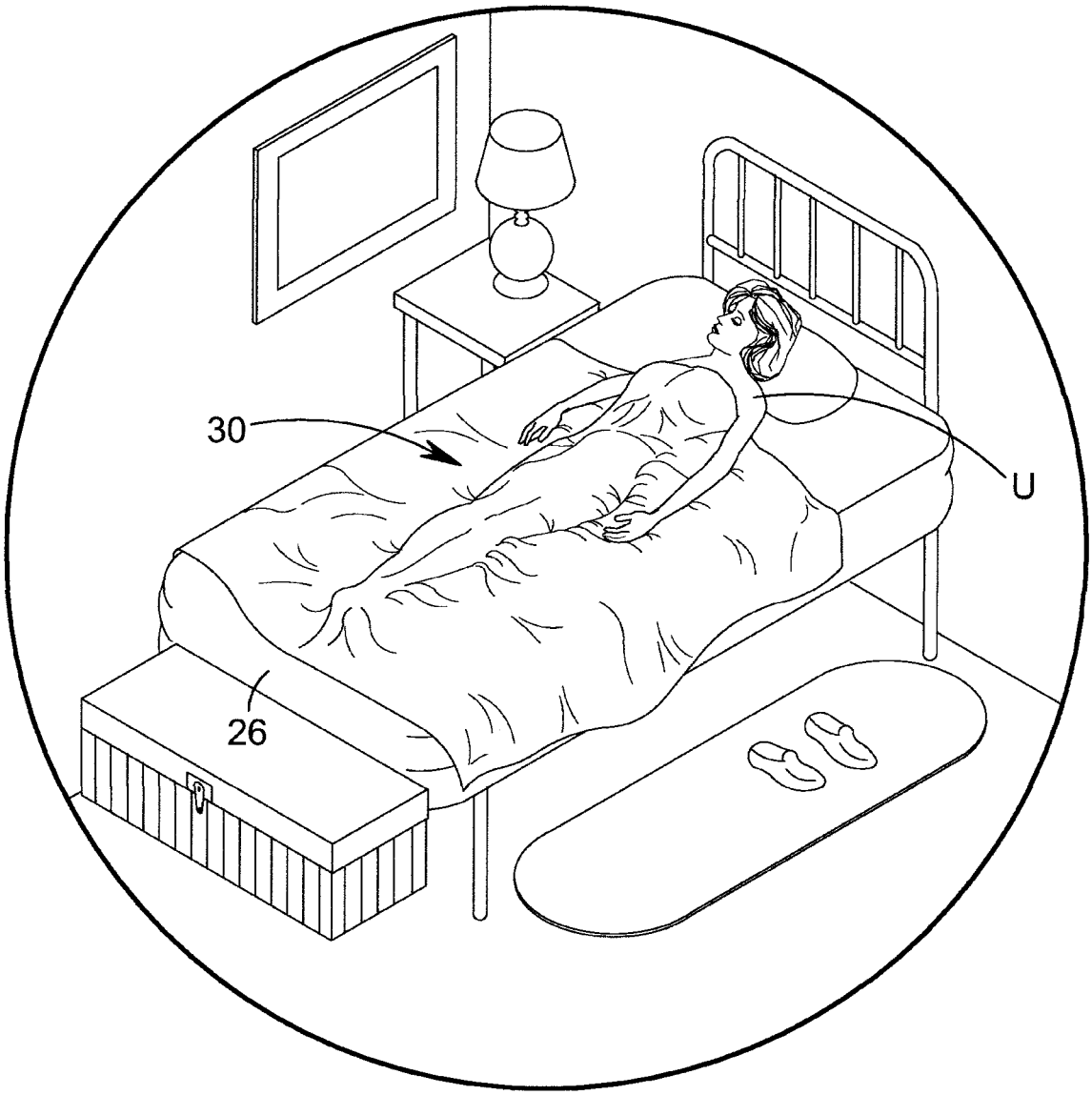
PRIOR ART FIG. 1
FIG. 1 is an overview of the prior art.

Turning, initially, to FIG. 1 of the accompanying drawing figures, a view of the prior art is seen. Over the course of time a user U sleeping in a regular position on mattress 26 causes a sleep indentation as indicated at 30. These sleep indentations 30 are annoying in that they may cause back problems as they become more pronounced and that they can lead to disturbed sleep. In many cases, makeshift solutions, such as boards or folded blankets located under the mattress are used, but these types of solutions are ineffective, difficult to fit, and can be felt by the user. Additionally, these makeshift solutions may cause more problems than they solve, by making portions of the mattress unaffected by the sleep indentations 30 too firm for the user's comfort.

Figure 2:
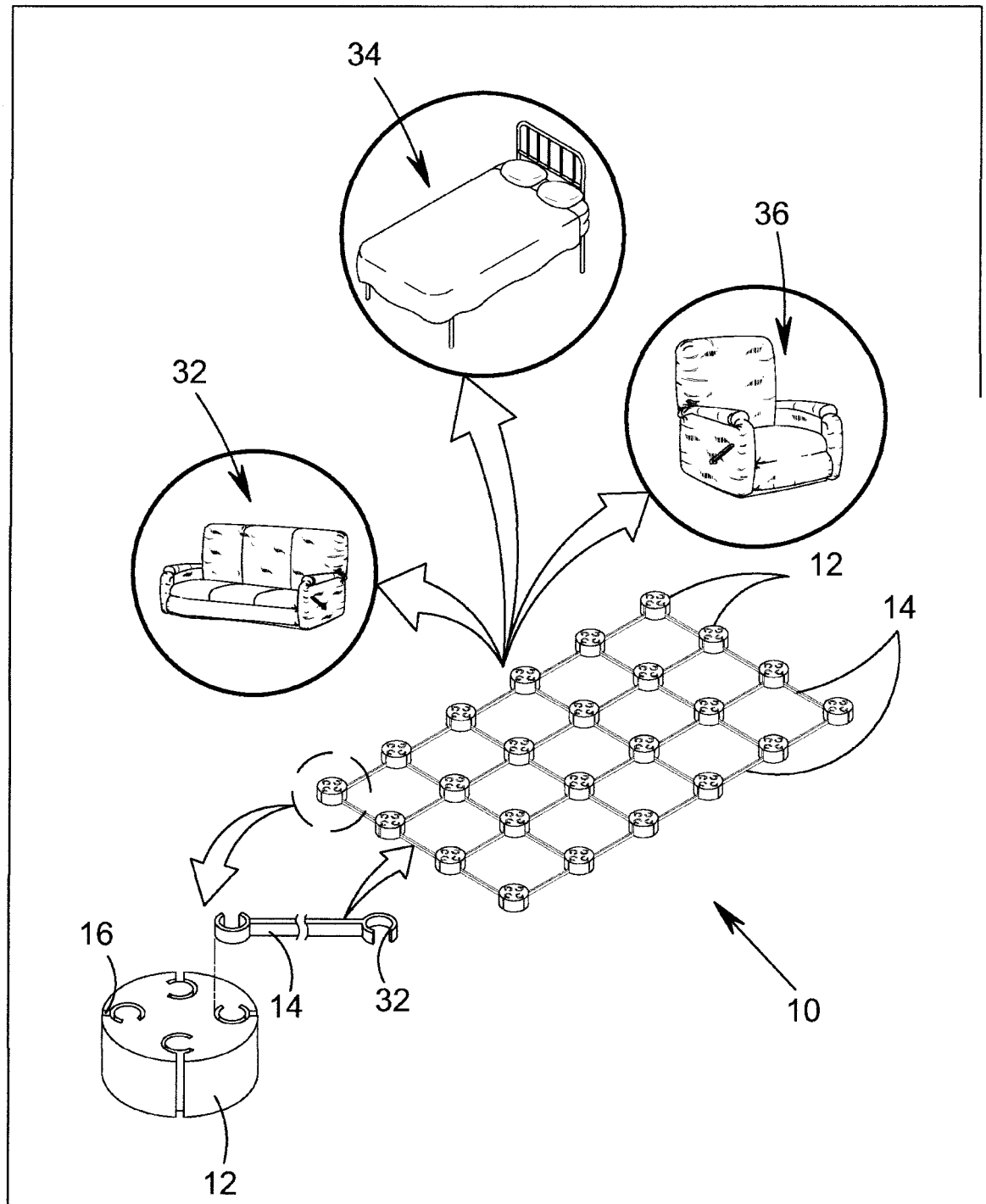
FIG. 2 is an overview of the present invention and its uses.

FIG. 2 shows the present invention, indicated at 10. The invention 10 includes a plurality of nodal foam blocks 12 attached one to the other by a plurality of nodal block connectors 14. As can be seen and as will be discussed further below, each of the nodal foam blocks includes contoured guide apertures 16 which are selectively engageable with nodal block connector engagement ends indicated at 38. The present invention 10 relieves the sagging that occurs over time in cushions, mattresses, and the like and as is seen in the Figure, the present invention 10 may be used to increase the comfort of an easy chair 36, a bed 34, or a sofa 32. Other types of furniture with cushions could, of course, also be addressed.

Figure 3A:
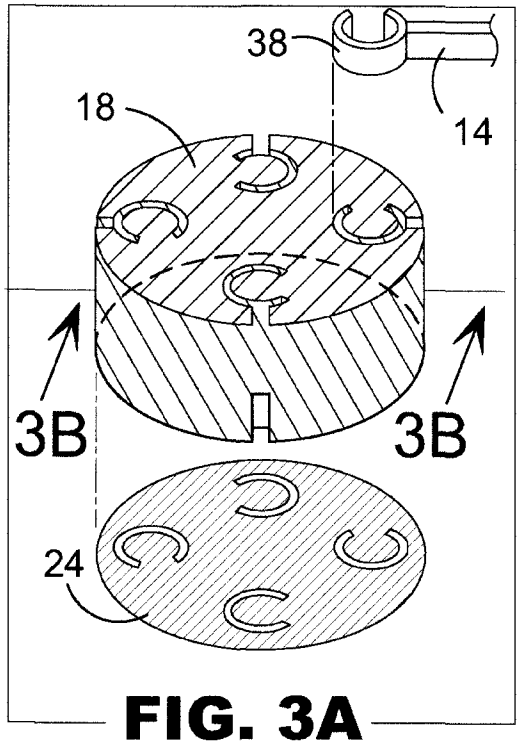
FIG. 3A is an overview of a single density nodal foam block.
Figure 3B:
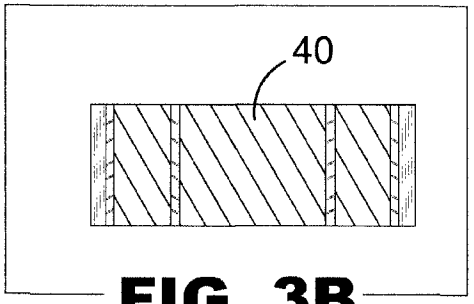
FIG. 3B is a cross-sectional view of the single density nodal foam block, taken from FIG. 3A, as indicated.
Figure 3C:
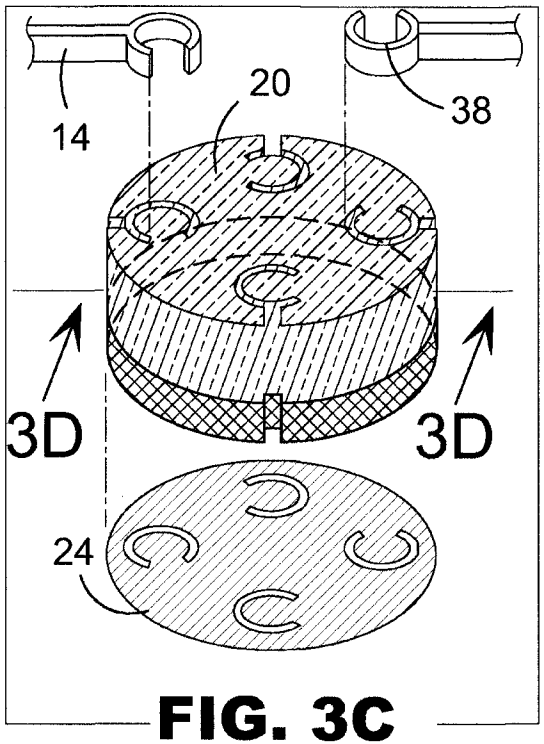
FIG. 3C is a prospective view of a multi-layered nodal foam block having differing densities.
Figure 3D:
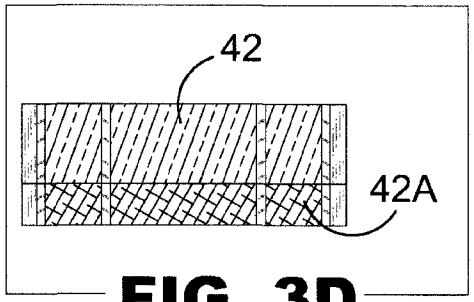
FIG. 3D is a cross-sectional view of the multi-layered nodal foam block, taken from FIG. 3C, as indicated.
Figure 3E:
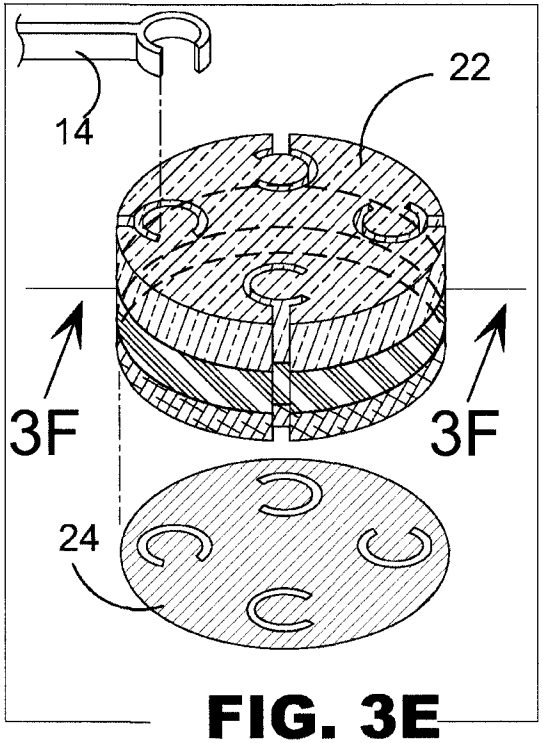
FIG. 3E is a prospective view of a nodal foam block having a plurality of layers having differing densities.
Figure 3F:
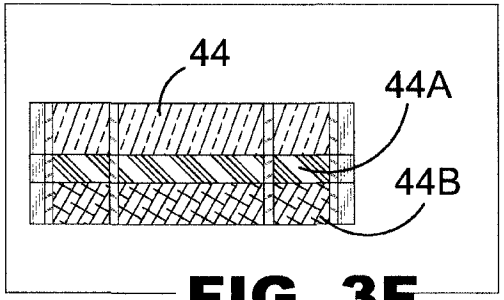
FIG. 3F is a cross-sectional view of the plural layered nodal foam block, taken from FIG. 3E, as indicated.

Turning now to FIGS. 3A to 3F, various types of foam construction involved in the nodal blocks 12 will be discussed. First in FIG. 3A a single layer of foam construction is shown and is indicated at 18. In FIG. 3B this single layer is indicated at 40. This layer 40 could include a density gradient from the bottom of the block proximate the adhesive base layer 24 to the top, or it could be consistent all the way through. In FIG. 3C a double layer of foam having different compressibility and densities is indicated generally at 20 and these layers are pointed out in FIG. 3D at 42 and 42A. Likewise, the adhesive base layer 24 is also seen. In FIG. 3E a triple layer of foam having different compressibility and densities is generally indicated at 22 and these layers are more specifically indicated in FIG. 3F at 44, 44A, and 44B. The various nodal foam blocks 12 (and the variations seen in this Figure at 18, 20, and 22) can be chosen by the user to provide the amount of support that is desired. It is contemplated that the varying compressibility combinations of these blocks 12 could be color coded to aid in the in-place assembly of the invention. Another aspect of the present invention is that either the density gradient of the blocks 12 as seen in the accompanying drawing figures or the layers of the blocks as indicated at 18, 20, and 22 allows for lateral or torsional movement of the upper portion of the blocks 12 (proximate the mattress) to prevent detection and sliding or the like, which provides additional comfort for the user once the present invention 10 is in place.

Figure 4:
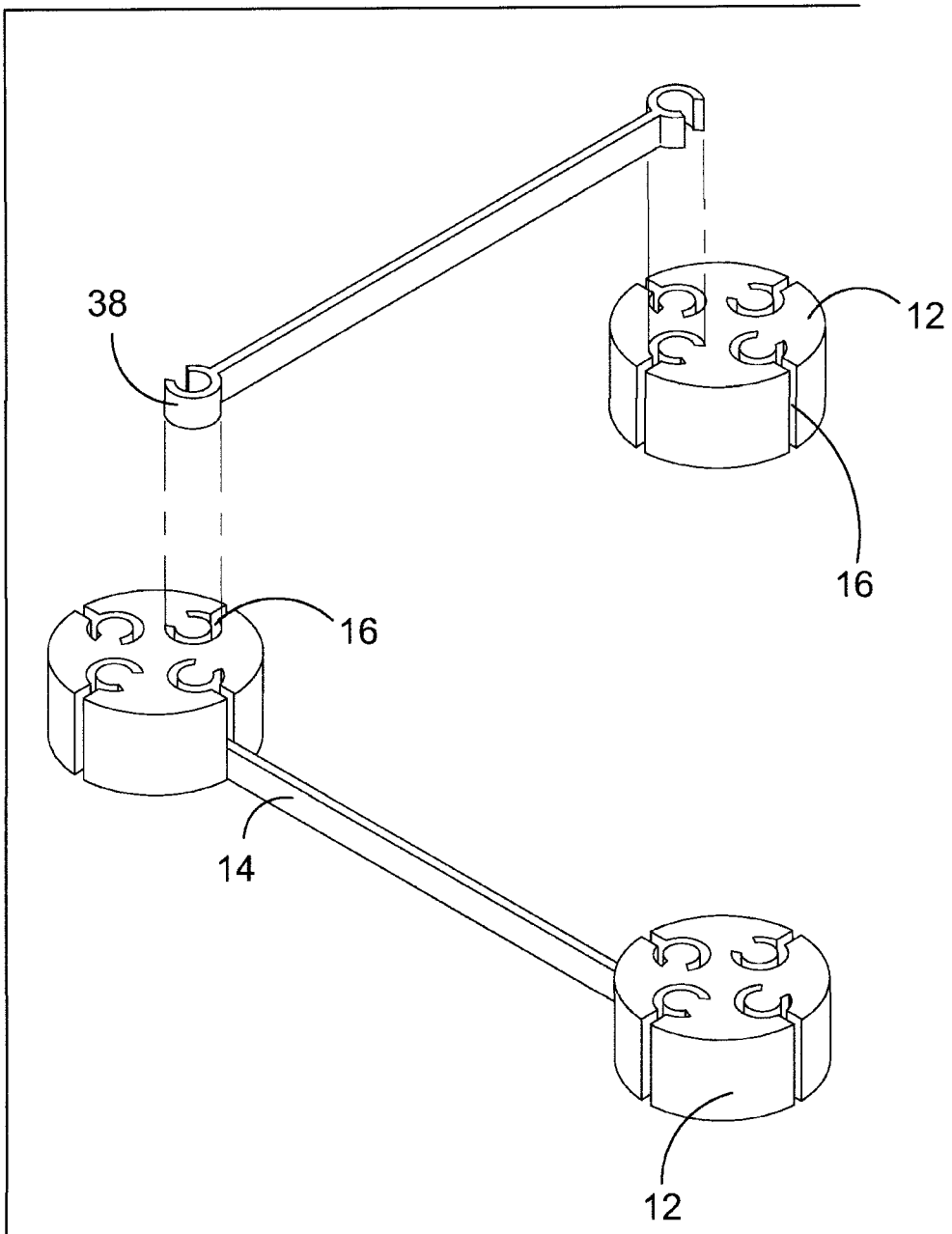
FIG. 4 is a prospective view of the nodal foam blocks and the block connectors.

Turning now to FIG. 4, the details of the connectors 14 will be discussed. As can be seen in the Figure, the blocks 12 are provided with a plurality of contoured guide apertures as indicated at 16. In this Figure these are seen as half-moon shaped slots extending substantially through the nodal foam blocks 12. The connectors 14 themselves are contemplated as being made of a flexible and compressible material, similar to that of the compressed nodal blocks 12 themselves. The flexibility of the block connectors 14 allow for even greater customization of the invention 10 as it is being installed. Also as discussed above, the flexibility and compressibility of the connectors 14 additionally add to the comfort of the device during use in that the user will be unaware of the present invention's presence below the mattress. It should be noted here that various types of mattresses will benefit from the application of the present invention such as inner spring mattresses, pillow top mattresses, and the like.

Figure 5:
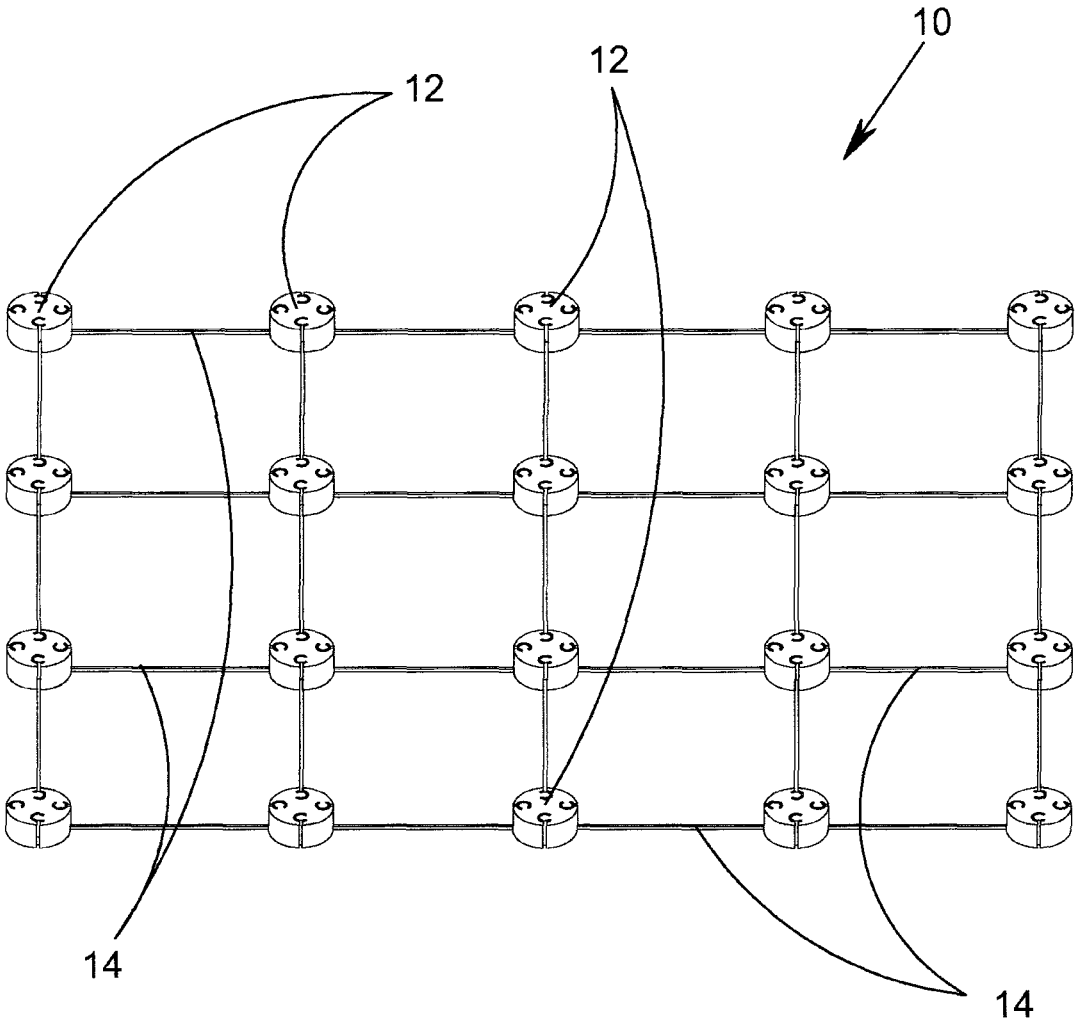
FIG. 5 is a perspective view of a preferred embodiment of the present invention with the block connectors latched to form a support between a box spring and the mattress.

FIG. 5 shows an assembled lattice array of the present invention 10 with the nodal foam blocks 12 and the block connectors 14 attached to one another to form an array that is to be placed under the sagging or weakened portion of the mattress, cushion, or the like.

Figure 6:
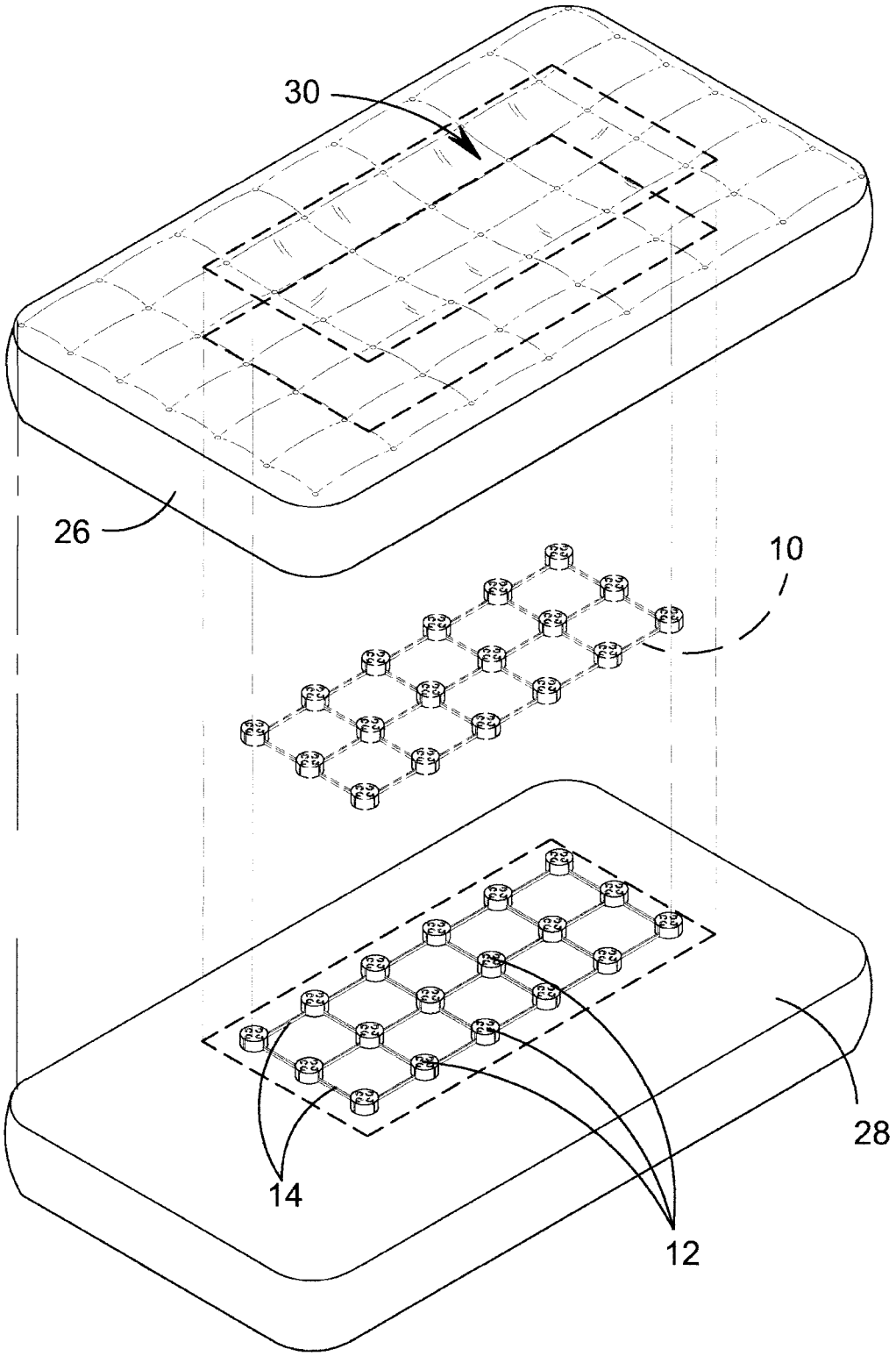
FIG. 6 is an exploded view of a preferred embodiment of the present invention in use between a box spring and a mattress.

The exploded view seen in FIG. 6 shows the present invention 10 ready to be placed as shown between the box spring 28 and the mattress 26 to solve the problem of the mattress sleep indentation indicated at 30. The present invention may be easily assembled and placed as needed.

Figure 7:
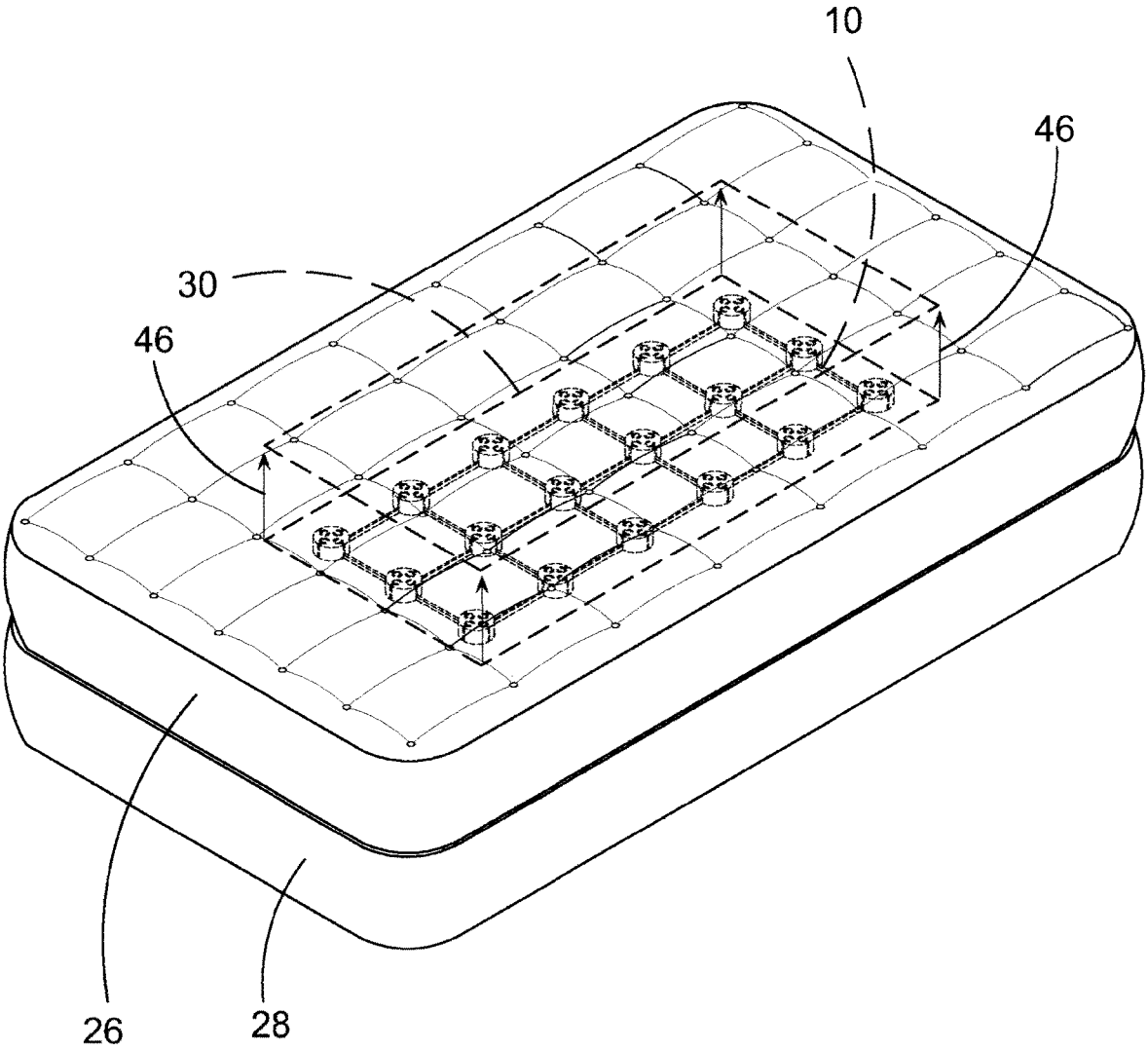
FIG. 7 is a prospective view showing a preferred embodiment of the present invention assembled in place between the box spring and the mattress.

In FIG. 7, the present invention 10 is shown in place between the mattress 26 and the box spring 28. The present invention eliminates the sleep indentation 30 as is indicated by the support arrows 46. One of the advantages of the present invention 10 is that no further adjustment is necessary once it is in place such as is needed with inflatable air bladders or the like.

Figure 8:
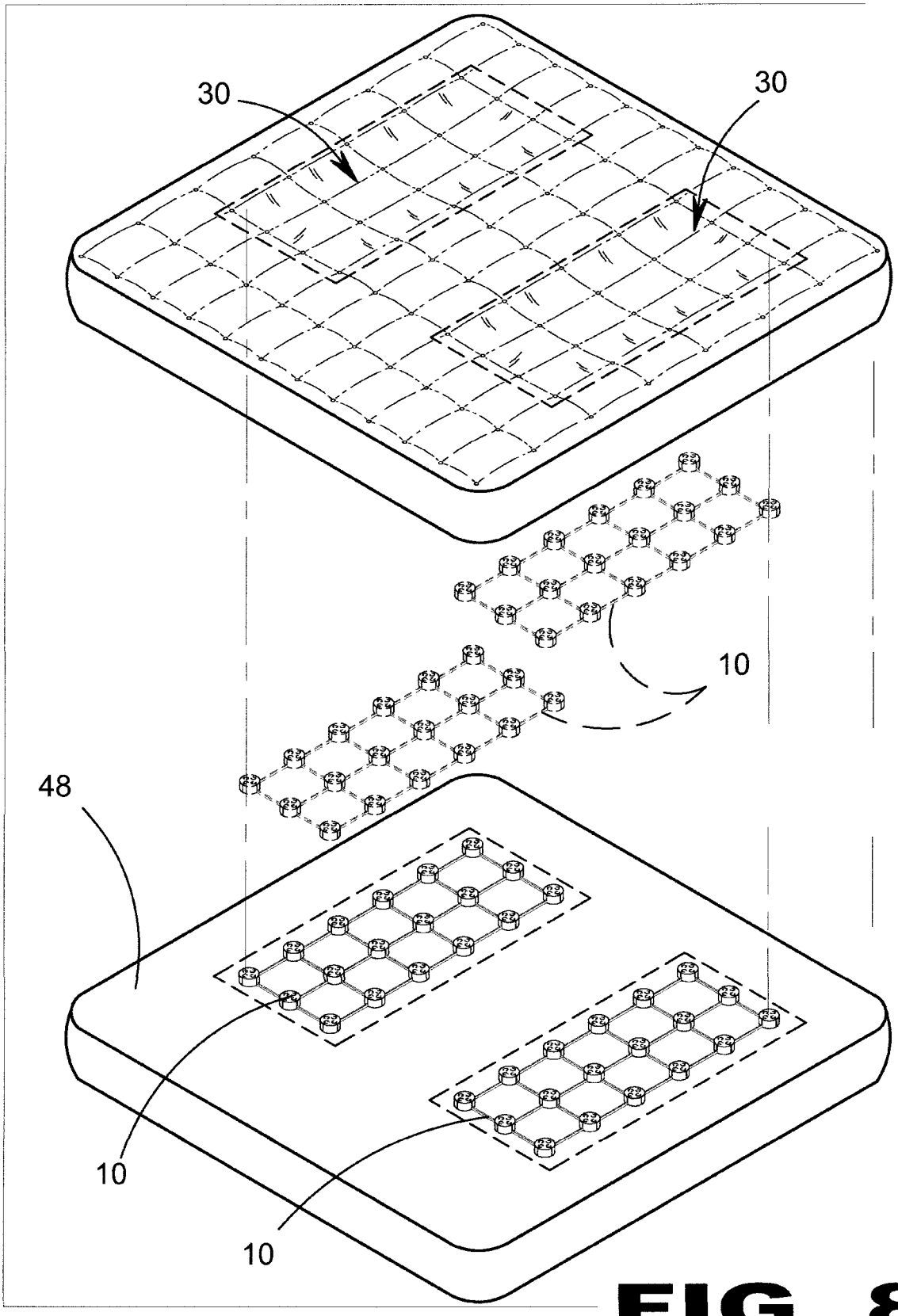
FIG. 8 is an exploded view of an embodiment of the present invention being used on a king-sized mattress with two sleep indentations.

Referring to FIG. 8, the present invention is shown being installed under a king-size mattress 50 and above the king-size box spring 48. The invention 10 is located beneath each of the mattress sleep indentations 30.

Figure 9:
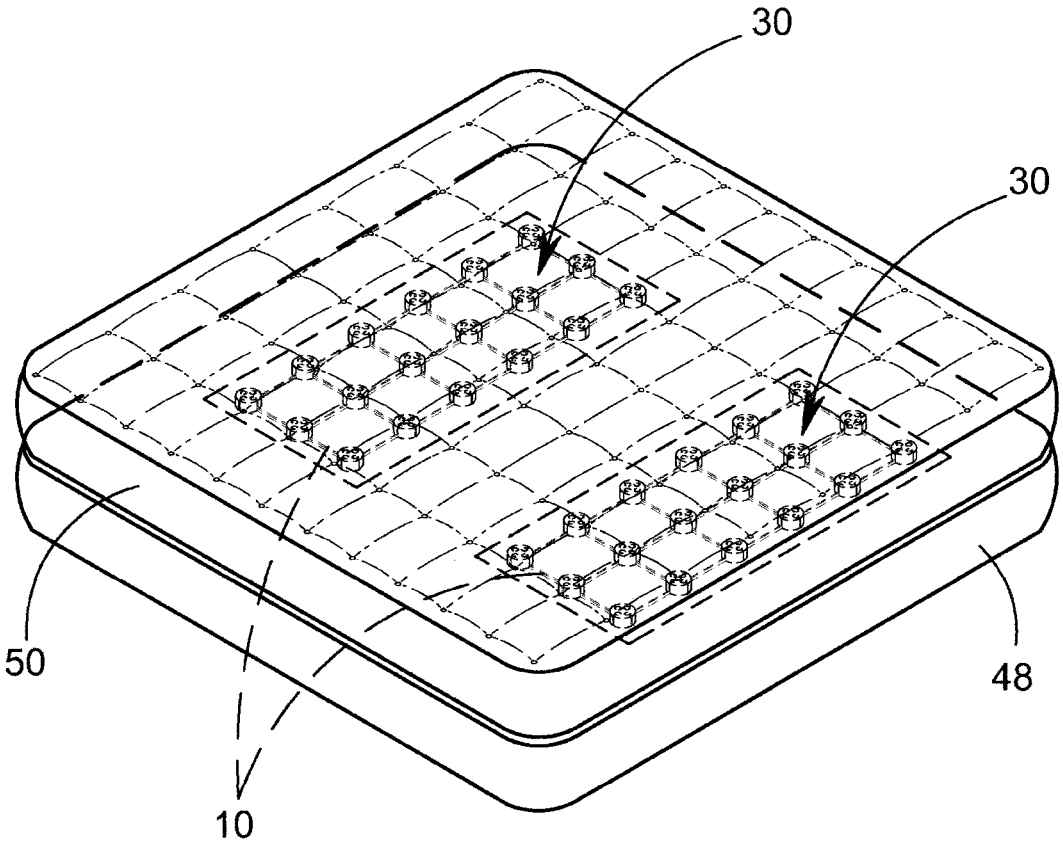
FIG. 9 is an assembled view of the present invention in a king-sized mattress related to that seen in FIG. 8.

FIG. 9 shows the present invention 10 in place between the king-size box spring 48 and the king-size mattress 50 and supporting the two mattress sleeping indentations as indicated at 30.

Figure 10:
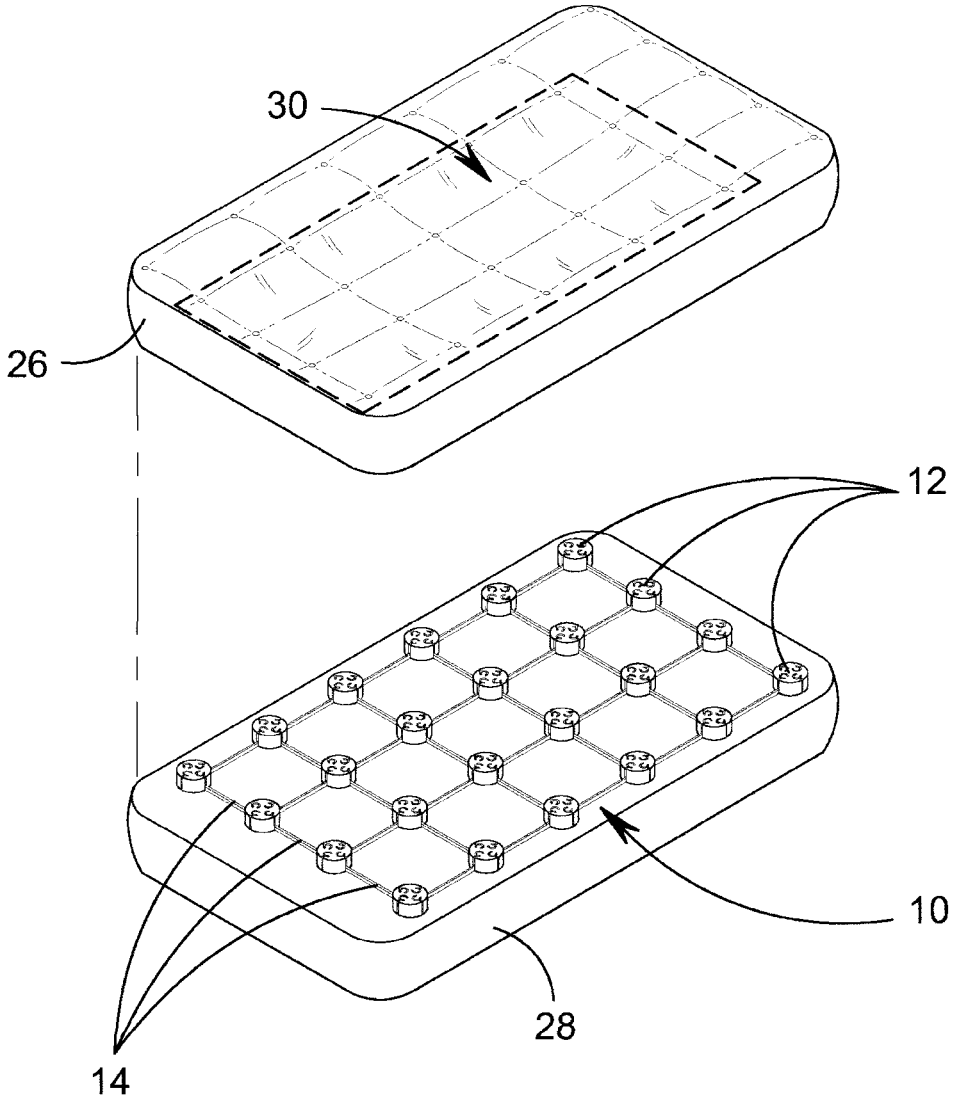
FIG. 10 is an exploded view of the present invention, in use.

FIG. 10 shows the present invention 10 assembled and placed between the mattress 26 and box spring 28 with the nodal foam blocks 12 and the connectors 14 spread in an array that is designed to support the mattress sleep indentation 30.

Figure 11:
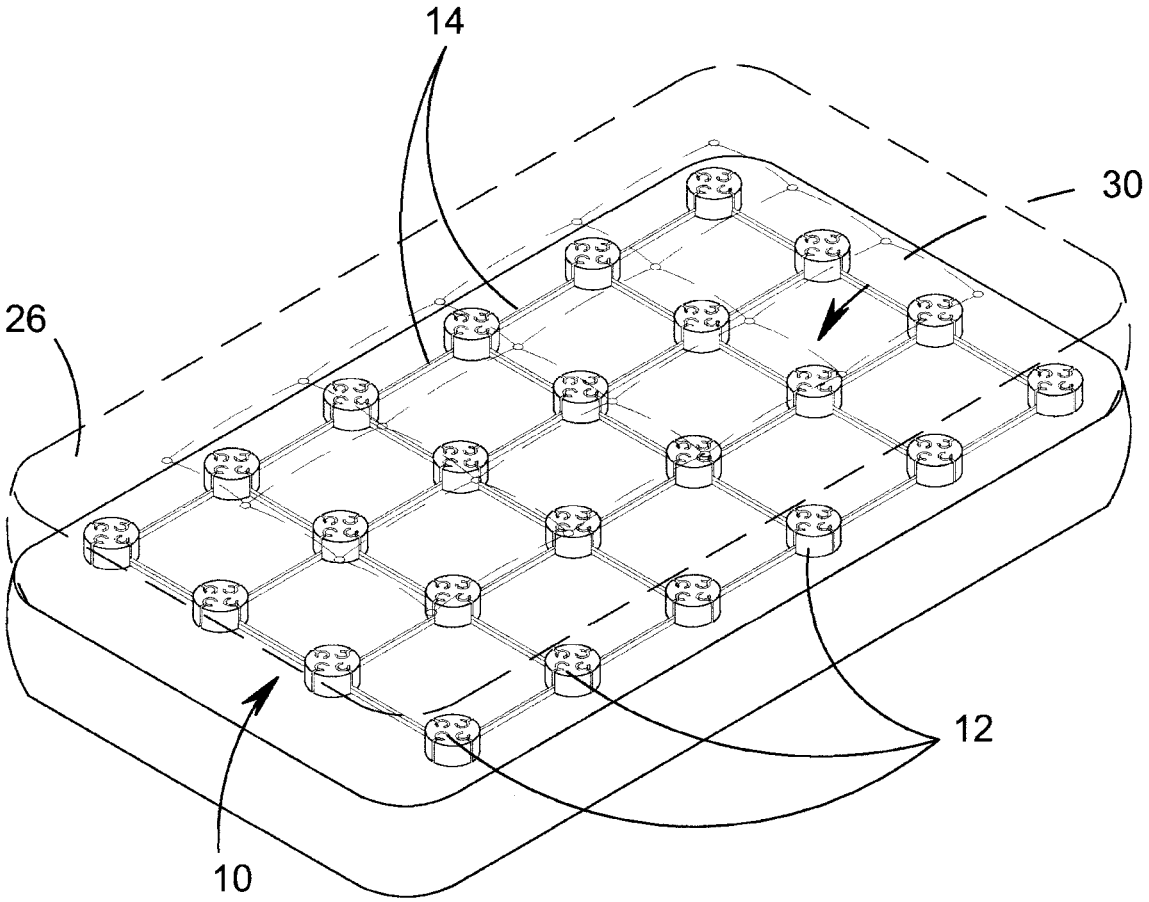
FIG. 11 is prospective, assembled view of the present invention, in use.

In FIG. 11 the present invention 10 is seen in place between the mattress 26 and the box spring 28 with the nodal foam blocks 12 and the corresponding connectors 14 forming a support lattice underneath the mattress sleep indentation 30.

Figure 12:
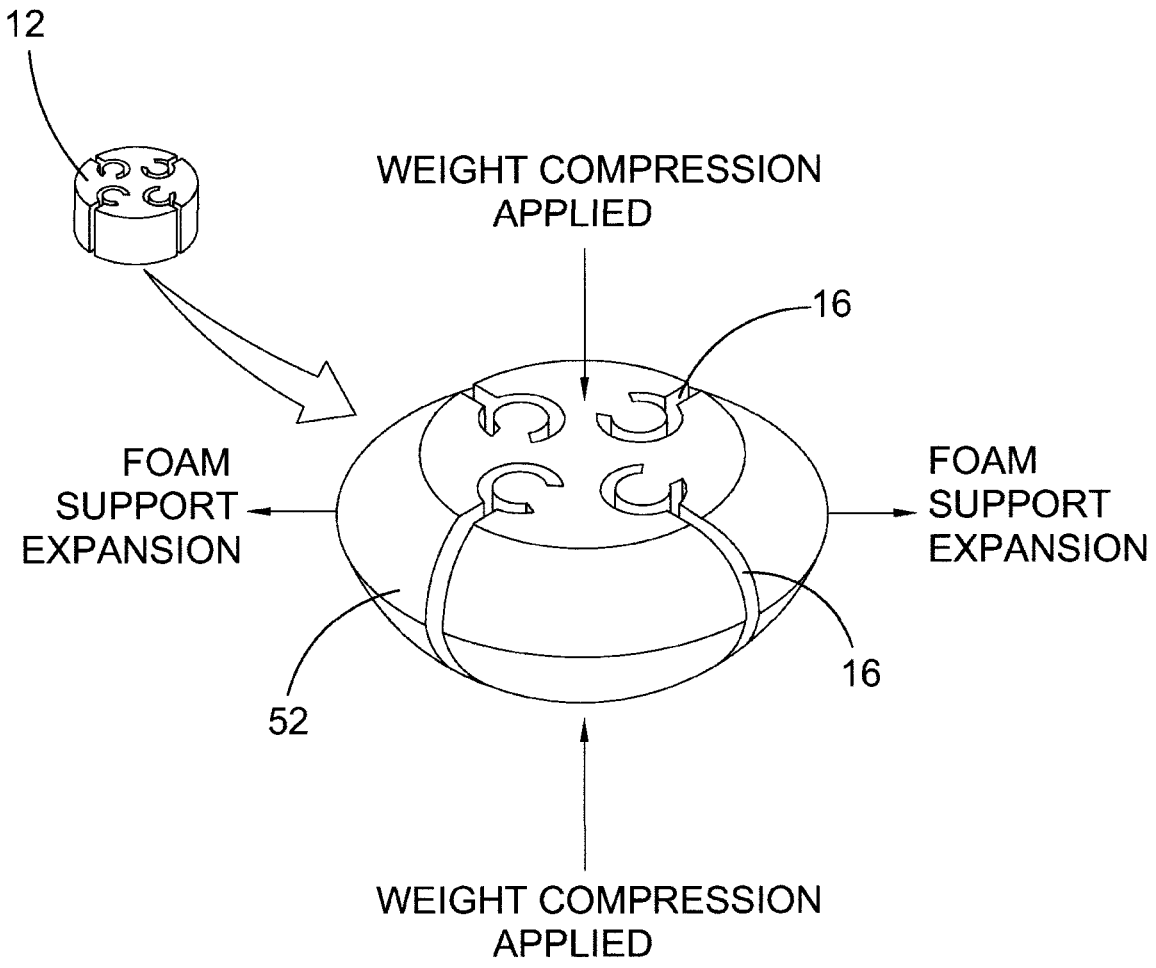
FIG. 12 is a perspective view of one of the nodal foam blocks under pressure.

FIG. 12 shows first the uncompressed nodal foam block 12 as is seen in the other Figures discussed above. Additionally, the Figure shows the compressed nodal foam block as indicated at 52 and the contoured guide apertures 16 adapted to receive the block connector engagement ends 38 of the block connectors 14 (neither seen in this Figure) as the compressed nodal block 52 stabilizes the mattress.

Turning to FIG. 13 various ends are disclosed for the block connectors indicated throughout the Figure at 14. First we see a star-shaped connector end at 58 with the corresponding star guide aperture 54. A square shaped connector end 60 has a square guide aperture 56. The diamond-shaped connector end 62 is fitted to a diamond-shaped receiving aperture 64, a cross-shaped connector end 66 is fitted to a cross-shaped receiving aperture 68, a round connector end 70 fits into a round receiving aperture 72 and, likewise, a hexagonal connector end 74 fits a hexagonal receiving aperture 76. It should be understood that any shape of connector ends and corresponding receiving apertures could be utilized in the performance of the present invention and these connector ends and receiving apertures are in no way limited to those seen in the accompanying drawing figures. As long as the present invention 10 is supported and stable in creating the lattice needed under the mattress the connecting shapes do not signify except that they provide a secure stable structure.

Turning now to FIGS. 14A through 14C various lattice configurations of the present invention are seen. In FIG. 14A a hexagonal lattice is made up of the nodal foam blocks 12 and the connectors 14. In FIG. 14B, the lattice created between the nodal foam blocks 12 and the connectors 14 is a square lattice. In FIG. 14C the lattice structure created between the nodal blocks 12 and the connectors 14 is comprised of triangles.

Thus the present invention 10 in use is adapted to restore a mattress, cushion, or like portion of a piece of furniture that has developed a sag or indentation through a combination of time and usage by providing a modular support that may be placed underneath the sagging portion. The varying degrees of compressibility provided by the novel nodal foam blocks indicated at 12 in the Figures and the compressible and flexible connector portions indicated at 14 in the Figures allows the user to custom fit the invention to a bed, chair, sofa, or the like that has a sag or sleep indentation therein. The construction of the nodal foam blocks with the varying degrees of compressibility attendant to them allows for small amounts of movement while the invention is in use without sliding. This feature is further enhanced by the adhesive pads located under the blocks 12. These adhesive pads or base layers indicated at 24 in FIGS. 3A, 3C, and 3E may be of a light enough tackiness that the nodal blocks 12 and the connectors 14 may be fixed and then moved as needed or desired.

Referring to FIG. 15, a series of nodal foam blocks 12 with connectors 14, the nodal foam blocks having a portion or region 12A removed therefrom with the removed portion 12B separately shown. The nodal foam blocks, as shown in FIG. 15, are oval-shaped, but could be circular or a variety of shapes and sizes. The removable region 12A can either remain empty during use or, in the alternative, be filled with another nodal foam portion, or nodal foam block element, that may be of different texture, support density or degree of compressibility than the removed portion 12B for providing a variety of different supporting nodal foam supports and which may have different support densities. It is also within the scope of the present invention that nodal foam pieces that may be inserted into removable region 12A can be of a vertical size (or height) that is greater or lesser than the nodal foam block 12 that surrounds the removable region 12A. There may also be a plurality of removable regions 12A, in addition to the single removable region illustrated in FIG. 15.

Finally, FIG. 16 provides a prospective view of the series of nodal foam blocks 12, as shown in FIG. 15, with removed portions 12B shown (by the vertical two-way arrows) as being capable of being removed from, or inserted into, the removable regions 12A of the nodal foam blocks 12. Again, the nodal foam blocks can have more than a single removable region 12A and can be of a height that differs from the height of the nodal foam block 12 and may be of a greater or lesser support density than the nodal foam block.

Thus the present invention 10 in use is adapted to restore a mattress, cushion, or like portion of a piece of furniture that has developed a sag or indentation through a combination of time and usage by providing a modular support that may be placed underneath the sagging portion. The varying degrees of compressibility provided by the novel nodal foam blocks indicated at 12 in the Figures and the compressible and flexible connector portions indicated at 14 in the Figures allows the user to custom fit the invention to a bed, chair, sofa, or the like that has a sag or sleep indentation therein. The construction of the nodal foam blocks with the varying degrees of compressibility attendant to them allows for small amounts of movement while the invention is in use without sliding. This feature is further enhanced by the adhesive pads located under the blocks 12. These adhesive pads or base layers indicated at 24 in FIGS. 3A, 3C, and 3E may be of a light enough tackiness that the nodal blocks 12 and the connectors 14 may be fixed and then moved as needed or desired.

While only several embodiments of the present invention have been shown and described, it will be obvious to those skilled in the art that many modifications may be made to the present invention without departing from the spirit and scope thereof.

What is claimed is:

1. A modular mattress renewal system, comprising:

a plurality of compressible nodal foam blocks, each of said compressible nodal foam blocks having a plurality of block connector guide apertures and further including nodal foam block adhesive portions, said plurality of compressible nodal foam blocks being a variable number of said compressible nodal foam blocks with the variable number of said compressible nodal foam blocks being adjustable for varying the number of said compressible nodal foam blocks between uses of said modular mattress renewal system; and, a plurality of nodal foam rod-shaped block connectors, each of said nodal foam rod-shaped block connectors having two nodal foam block connector engagement ends for being received in the block connector guide apertures, with an opening in a sidewall of each of said compressible nodal foam blocks permitting each of said nodal foam rod-shaped block connectors to be inserted along a vertical axis of each of said compressible nodal foam blocks, each said nodal foam rod-shaped block connector separating two compressible nodal foam blocks of said plurality of compressible nodal foam blocks in a non-contiguous spatial arrangement with empty spacing between said plurality of compressible nodal foam blocks, wherein said plurality of compressible nodal foam blocks with said plurality of nodal foam rod-shaped connectors are placed underneath a mattress, and not incorporated into the mattress, and fixed in place via said nodal foam block adhesive portions with said nodal foam rod-shaped block connectors being attached via said nodal foam block connector engagement ends for forming a supporting lattice for supporting at least a portion of the mattress by said plurality of compressible nodal foam blocks.

2. The modular mattress renewal system according to claim 1, wherein said plurality of nodal foam rod-shaped block connectors are flexible and compressible.

3. The modular mattress renewal system according to claim 1, wherein each of said compressible nodal foam blocks includes a compressibility gradient extending from a more compressible upper, mattress engaging layer to a less compressible lower, nodal foam block adhesive portion layer for preventing inadvertent movement of said modular mattress renewal system when fixed in place.

4. The modular mattress renewal system according to claim 3, wherein further comprising an additional compressible layer located between said more compressible upper layer and said less compressible lower layer, said additional compressible layer being least compressible and less compressible than said less compressible lower layer.

5. The modular mattress renewal system according to claim 1, wherein said supporting lattice has a rectangular shape.

6. The modular mattress renewal system according to claim 1, wherein said supporting lattice has a hexagonal shape.

7. The modular mattress renewal system according to claim 1, wherein said plurality of compressible nodal foam blocks have a cylindrical shape.

8. The modular mattress renewal system according to claim 1, wherein said plurality of compressible nodal foam blocks have a non-cylindrical shape.

9. The modular mattress renewal system according to claim 1, wherein said plurality of compressible nodal foam blocks have an oval shape.

10. A modular mattress renewal system, comprising:

a plurality of compressible nodal foam blocks, each of said compressible nodal foam blocks having a plurality of block connector guide apertures and further including nodal foam block adhesive portions, said plurality of compressible nodal foam blocks being a variable number of said compressible nodal foam blocks with the variable number of said compressible nodal foam blocks being adjustable for varying the number of said compressible nodal foam blocks between uses of said modular mattress renewal system, at least one compressible nodal foam block of said plurality of compressible nodal foam blocks having a removable region within a perimeter of said at least one compressible foam block having said removable region for removing a portion of said at least one compressible nodal foam block for providing differing compressible support by said at least one compressible nodal foam block; and, a plurality of nodal foam rod-shaped block connectors, each of said nodal foam rod-shaped block connectors having two nodal foam block connector engagement ends for being received in the block connector guide apertures, with an opening in a sidewall of each of said compressible nodal foam blocks permitting each of said nodal foam rod-shaped block connectors to be inserted along a vertical axis of each of said compressible nodal foam blocks, each said nodal foam rod-shaped block connector separating two compressible nodal foam blocks of said plurality of compressible nodal foam blocks in a non-contiguous spatial arrangement with empty spacing between said plurality of compressible nodal foam blocks, wherein said plurality of compressible nodal foam blocks with said plurality of nodal foam rod-shaped connectors are placed underneath a mattress, and not incorporated into the mattress, and fixed in place via said nodal foam block adhesive portions with said nodal foam rod-shaped block connectors being attached via said nodal foam block connector engagement ends for forming a supporting lattice for supporting at least a portion of the mattress by said plurality of compressible nodal foam blocks.

11. The modular mattress renewal system according to claim 10, further comprising a nodal foam block element able to be inserted into said removable region of said at least one compressible nodal foam block following removal of said portion from said removable region of said at least one compressible nodal foam blocks.

12. The modular mattress renewal system according to claim 11, wherein said nodal foam block element insertable into said removable region of said at least one compressible nodal foam block has a degree of compressibility that is different than a degree of compressibility of said at least one compressible nodal foam block.

13. The modular mattress renewal system according to claim 11, wherein said nodal foam block element insertable into said removable region of said at least one compressible nodal foam block has a vertical height that is greater than a vertical height of said at least one compressible nodal foam block.

14. The modular mattress renewal system according to claim 11, wherein said nodal foam block element insertable into said removable region of said at least one compressible nodal foam block has a vertical height that is less than a vertical height of said at least one compressible nodal foam block.

15. The modular mattress renewal system according to claim 10, wherein said at least one compressible nodal foam block of said plurality of compressible nodal foam blocks includes a plurality of removable regions for removing a plurality of portions of said at least one compressible nodal foam block.

16. The modular mattress renewal system according to claim 10, wherein said plurality of removable regions of said at least one compressible nodal foam block are each able to be replaced by a nodal foam block element of differing degrees of compressibility.

* * * * *